US005233392A

United States Patent [19]

Kitamura

[11] Patent Number: 5,233,392

[45] Date of Patent: Aug. 3, 1993

[54] IMAGE RECORDING APPARATUS HAVING A PARTICLE CONTROL ELECTRODE

[75] Inventor: Tetsuya Kitamura, Gifu, Japan

[73] Assignee: Brother Kogyo Kabushiki Kaisha, Nagoya, Japan

[21] Appl. No.: 918,690

[22] Filed: Jul. 27, 1992

[30] Foreign Application Priority Data

Aug. 19, 1991 [JP] Japan ..... 3-206761

[51] Int. Cl.[5] ..... G03G 15/06

[52] U.S. Cl. ..... 355/261; 346/159; 355/245

[58] Field of Search ..... 118/652, 654; 346/159, 346/153.1, 157, 160.1; 355/245, 246, 215, 261, 251, 262

[56] References Cited

U.S. PATENT DOCUMENTS

| | | | |
|---|---|---|---|
| 3,689,935 | 9/1972 | Pressman et al. . | |
| 4,397,265 | 8/1983 | Terashima | 118/694 |
| 4,423,950 | 1/1984 | Sagami | 118/652 X |
| 4,478,510 | 10/1984 | Fujii et al. . | |
| 4,491,855 | 1/1985 | Fujii et al. | 346/159 |
| 4,498,090 | 2/1985 | Honda et al. | 346/159 |
| 4,568,955 | 2/1986 | Hosoya et al. | 346/153.1 |
| 4,984,019 | 1/1991 | Folkins | 355/215 |
| 5,027,157 | 6/1991 | Hotomi et al. | 355/261 |
| 5,153,611 | 10/1992 | Kokado et al. | 355/261 X |

FOREIGN PATENT DOCUMENTS

| | | |
|---|---|---|
| 0410738A2 | 1/1991 | European Pat. Off. . |
| 53-149031 | 12/1978 | Japan . |
| 62-176873 | 8/1987 | Japan . |
| 2-287568 | 11/1990 | Japan . |

OTHER PUBLICATIONS

IBM Technical Disclosure Bulletin "Anticlogging Ink Jet Nozzle Chamber" by R. J. von Gutfeld, vol. 17, No. 6, pp. 1802–Nov. 1974.

*Primary Examiner*—A. T. Grimley
*Assistant Examiner*—T. A. Dang
*Attorney, Agent, or Firm*—Oliff & Berridge

[57] ABSTRACT

The image recording apparatus of the invention generates an electric field between a particle control electrode, which has apertures, and an electrode roller to directly control the flow of toner particles to record an image on an image recording medium which passes between the electrode and the roller. While the image is recorded, a piezoelectric member mounted on the particle control electrode causes the particle control electrode to vibrate using variable oscillation frequency which will coincide, at least at one time, with the resonance frequency of the particle control electrode. The oscillation frequency is applied from a variable frequency oscillator to the piezoelectric member so that the control electrode is vibrated at a large amplitude. As a result, the toner particles do not adhere to the apertures and the apertures do not become clogged with the toner particles. A high-quality output image will thus be obtained.

18 Claims, 3 Drawing Sheets

IMAGE RECORDING APPARATUS HAVING A PARTICLE CONTROL ELECTRODE

BACKGROUND OF THE INVENTION

1. Field of the Invention

The invention relates to an image recording apparatus used in copy machines and printers which has a particle control electrode having apertures and controls the flow of charged toner particles passed through the apertures.

2. Description of Related Art

This kind of image recording apparatus includes a toner particle supply source, a particle control electrode having apertures and an electrode roller. The charged toner particles are supplied from the toner particle supply source near the particle control electrode and the flow of the charged toner particles to the apertures is controlled by the particle control electrode. The toner particles controlled so as to pass through the aperture are attracted in the direction of the electrode roller and are attached on a support member which is fed by the electrode roller and an image is formed thereon. As one of this kind of image recording apparatus, there has been proposed, for example, an image recording apparatus disclosed in U.S. Pat. No. 3,689,935.

However, when an image is recorded using the above mentioned image recording apparatus, a problem occurred in that the apertures of the particle control electrode become clogged with the toner particles. U.S. patent application Ser. No. 07/680.728. discloses an image recording apparatus having vibration applying means for vibrating the particle control electrode to prevent the apertures of the particle control electrode from being clogged by the toner particles thereby greatly improving the record stability. Further, the amplitude of the vibration has been greatly increased by making the particle control electrode vibrate with the frequency by which the particle control electrode resonates and thereby the maximum effect is obtained.

However, the toner particles which do not take part in the modulating control by the particle control electrode are also attracted to the particle control electrode. Therefore, a part of the toner particles accumulates in the position where the amplitude of the vibration of the particle control electrode is small. namely the node of the vibration. The resonance frequency of the particle control electrode is changed by the change of weight and form of the particle control electrode caused by this accumulation of the toner particles. On the other hand, the frequency of the vibration applied by the vibration applying means is invariable so that it no longer coincides with the changed resonance frequency of the particle electrode. As a result, the amplitude of the vibration of the particle control electrode becomes small as a whole and the area to which the toner particles are attached extends further. Further, the above adherence of toner particles and the decrease in the amplitude of the vibration of the particle control electrode are repeated until the toner particles are accumulated along the entire surface of the particle control electrode and apertures of the particle control electrode become clogged with the toner particles.

SUMMARY OF THE INVENTION

An object of the invention is to provide an image recording apparatus capable of printing a high-quality image by making the particle control electrode vibrate around a resonance frequency thereof, namely one with a large amplitude, and by completely preventing clogging apertures of the particle control electrode.

In order to attain the above objects an image recording apparatus according to this invention comprises: toner particle supplying means for supplying charged toner particles; a particle control electrode having at least one row of apertures which controls passage of the charged toner particles supplied by the toner particle supplying means through the apertures; a back electrode confronting the toner particle supplying means through the particle control electrode for attracting the toner particles passed through the apertures of the particle control electrode, the back electrode spaced from the particle control electrode by a space enabling passage of an image recording medium; vibration applying means connected to the particle control electrode for applying vibration to the particle control electrode; and changing means for changing a frequency of the vibration applied to the particle control electrode by the vibration applying means.

According to the image recording apparatus thus constructed, it becomes possible to vibrate the particle control electrode always in a range including its resonance frequency because the vibrating frequency of the particle control electrode is changed even if the image recording apparatus is driven and the resonance frequency of the particle control electrode is changed by the attachment of the toner particles to the node of the vibration thereof. That is, it is possible to make the particle control electrode vibrate by a large amplitude. Moreover, it becomes possible to eliminate the part of the particle control electrode that vibrates with a small amplitude by applying some vibration having a variable wavelength to the particle control electrode.

According to the image recording apparatus of the invention thus constructed, the toner particles that adhere or which are about to adhere on the particle control electrode can be dislodged, based upon a large vibration acceleration, so that it becomes possible to prevent the apertures of the particle control electrode from being clogged by the toner particles. Therefore, it becomes possible to obtain a high-quality output image by this image recording apparatus.

BRIEF DESCRIPTION OF THE DRAWINGS

A preferred embodiment of the invention will be described in detail with reference to the following figures wherein.

DETAILED DESCRIPTION OF THE PREFERRED EMBODIMENT

Referring now to the accompanying drawings, a preferred embodiment of the invention will be described in detail.

Figure 1:
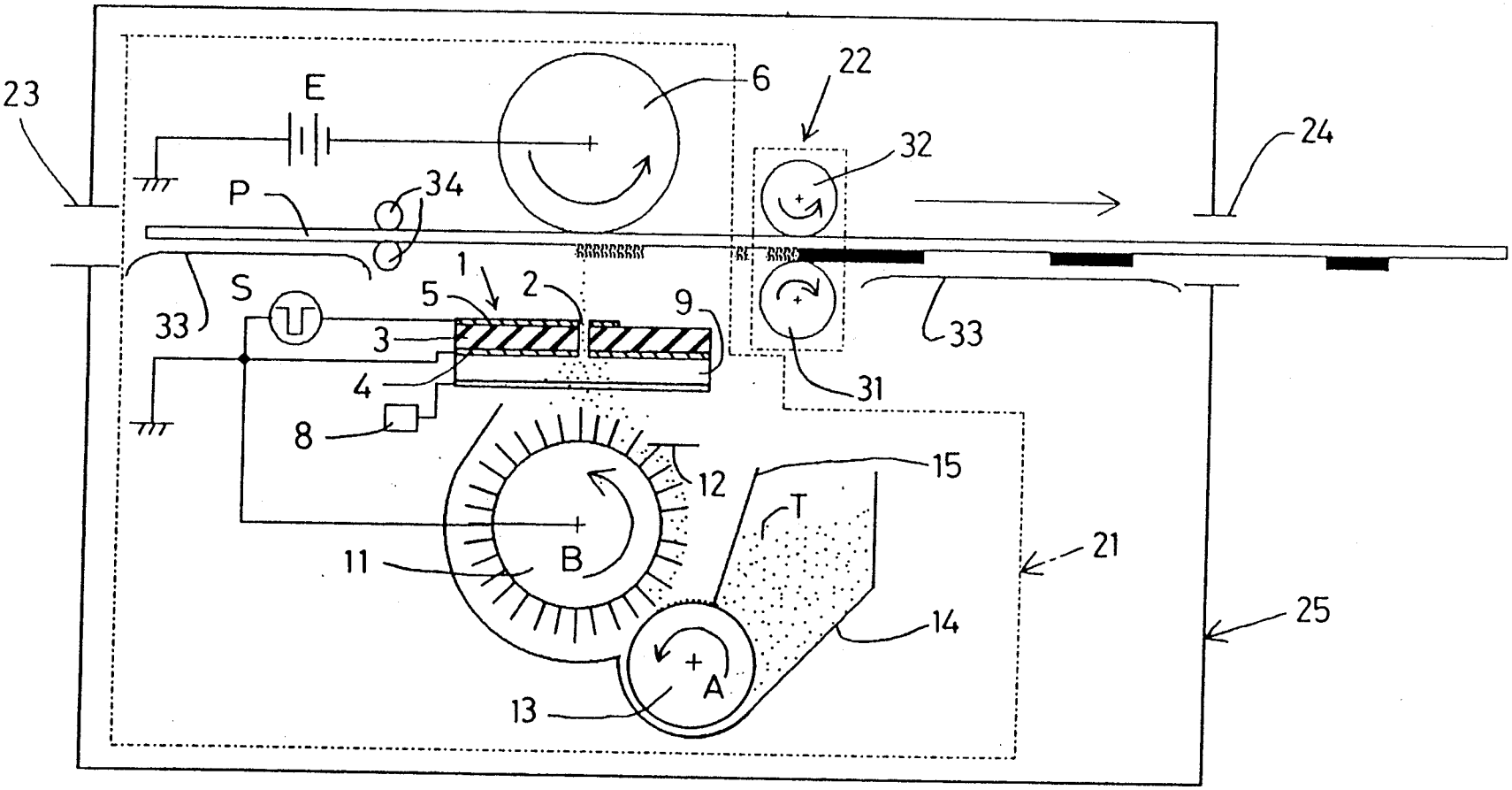
FIG. 1 schematically shows the structure of an image recording apparatus which embodies the invention.

As shown in FIG. 1, an image recording apparatus 25 is roughly divided into an image recording portion 21 and a thermal fixing portion 22.

On one side of the image recording apparatus 25 is a sheet inlet 23 for inserting a recording medium P on which an image will be recorded and, one another side is a sheet outlet 24 for discharging the recording medium P having the image recorded thereon. The image recording portion 21 and the thermal fixing portion 22 are installed inside of the apparatus.

The main part of the image recording portion 21 comprises a rotatable brush roller as a carrying device, and a particle control electrode 1 as a toner particle flow modulating device. Around the brush roller 11, a supply roller 13 and a scratch member 12 are arranged along the rotating direction indicated by the arrow B. A supply roller blade 15 is arranged to be spaced from the supply roller 13 by a predetermined space. The supply roller 13 is installed in a toner particle case 14 in which toner particles T are stored.

Figure 2:
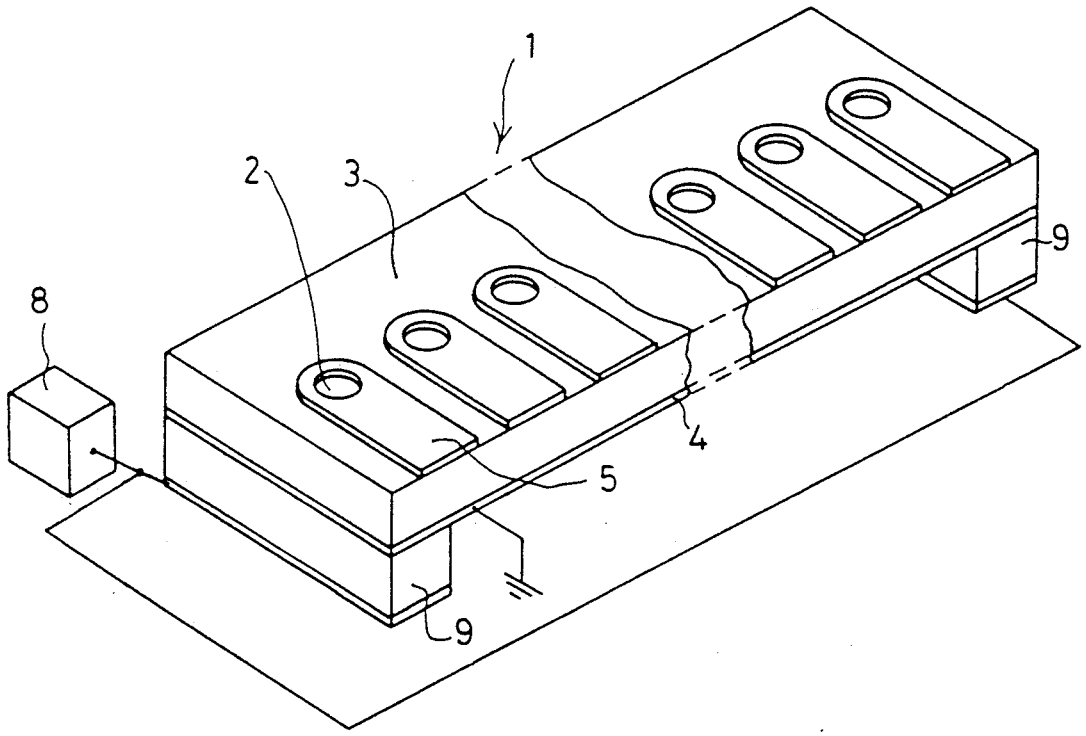
FIG. 2 is a perspective view of a particle control electrode provided in the image recording apparatus of the invention.

The particle control electrode 1 is arranged above the brush roller 11. As shown in FIG. 2, the particle control electrode 1 comprises a plurality of apertures 2, an insulative layer 3, a reference electrode 4 and a plurality of segment control electrodes 5. The insulative layer 3 is a thin board which comprises an insulating material. The reference electrode 4 is installed on the insulative layer 3 and confronts the brush roller 11, the reference electrode 4 and the brush roller 11 being grounded. The plurality of apertures 2 penetrate the segment control electrode 5, the insulative layer 3 and the reference electrode 4. Moreover, the plurality of apertures 2 are arranged in one line. Each segment control electrode 5 is a metallic layer installed independently around each aperture 2 and on the side of the insulative layer 3 opposite the side where the reference electrode 4 is installed. The reference electrode 4 is grounded. The plurality of segment control electrodes 5 are each connected independently to an image signal source S. The image signal sources are installed to correspond to the number of the segment control electrodes 5.

A pair of piezoelectric elements. 9, as a vibration applying device, are arranged on the surface of the reference electrode 4 of the particle control electrode 1. The piezoelectric elements 9 are transformed by a vibration voltage applied from a general variable frequency oscillator 8, and are constructed so that the particle control electrode 1 may be vibrated. An oscillation frequency which can make the particle control electrode 1 resonate is chosen as a reference frequency of the voltage for the variable frequency oscillator 8. That is, when the particle control electrode is resonated, the amplitude of the vibration thereof becomes a maximum. So that, it is possible to obtain a vibration amplitude of considerable magnitude compared with the case where the particle control electrode is not resonated. Generally, the particle control electrode 1 is designed so that the value of the resonance frequency thereof is more than 20 kHz. A vibration of a frequency of 20 kHz does not become noise because it exceeds the human audible range. In this embodiment, for instance, the resonance frequency of the particle control electrode 1 is set at 30 kHz.

The time taken for printing one dot is 1.7 milliseconds with a resolution of 300 dpi (dot per inch) and, using A4 size paper, the printing speed is 10 ppm (page per minute). Moreover, the varying of the resonance frequency of the particle control electrode 1 is several tens of Hz at the most. Therefore, a vibration voltage which changes ±100 hertz around 30 kHz during 1.7 milliseconds can be generated from the variable frequency oscillator 8.

Figure 3:
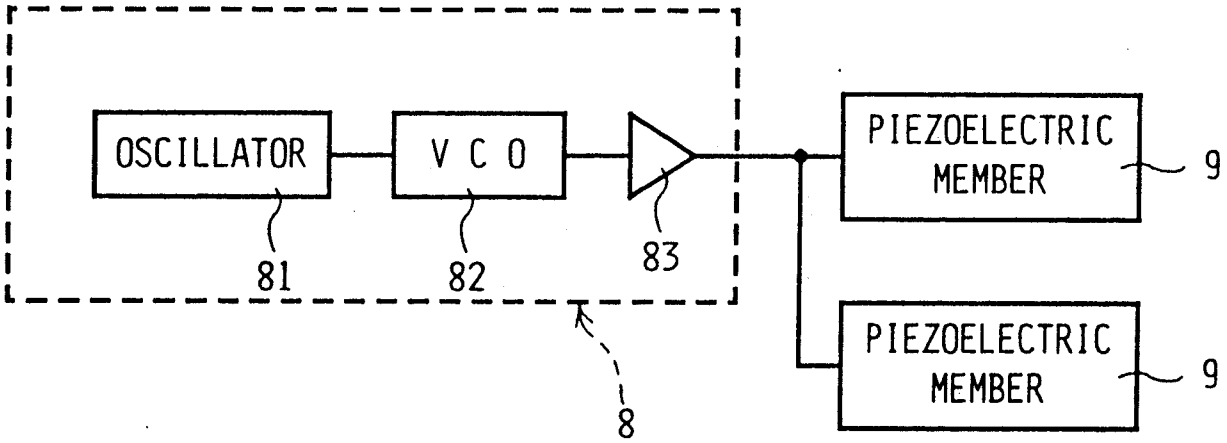
FIG. 3 is a block diagram of a variable frequency oscillator.

As shown in FIG. 3, the variable frequency oscillator 8 includes a oscillator 81, a VCO (Voltage Controlled Oscillator) 82 and an amplifier 83. The VCO 82 can change the frequency of the output signal according to the voltage supplied from the oscillator 81. In this embodiment, the VCO 82 generates the oscillating voltage of 30 kHz when the voltage supplied from the oscillator 81 is 0 V. When the voltage supplied from the oscillator 81 changes from 1 V to −1 V, the oscillating voltage generated from the VCO 82 changes from 30.1 kHz to 29.9 kHz. In order to change the frequency of the oscillating voltage generated from the VCO 82 ±100 Hz around 30 kHz during 1.7 milliseconds, the oscillator 81 supplies the voltage of ±1 V to the VCO 82 during the cycle of 1.7 milliseconds. The amplifier 83 amplifies the oscillating voltage generated by the VCO 82 and applies it to the piezoelectric members 9.

Moreover, a rotatable electrode roller 6 is installed confronting the brush roller with the particle control electrode therebetween. There is a space between the electrode roller 6 and the particle control electrode 1. The image recording medium P inserted from the sheet inlet 23 is fed by a pair of feeding rollers 34 and the guide 33 and passes through this space.

The electrode roller 6 is connected to a direct current power supply E, and a voltage having an opposite polarity (in case of this embodiment, it is negative polarity) to that of charged toner particles T (having a positive polarity) which passed through the particle control electrode is applied. The toner particles T which have passed through the apertures 2 of the particle control electrode 1 are attracted to the electrode roller 6 by this applied voltage.

Therefore, the toner particles T attracted to the electrode roller 6 adhere to the image recording medium P which passes between the particle control electrode 1 and the electrode roller 6. In addition, the image recording medium P is separated from the electrode roller 6 after passing through the image recording portion 21, and is sent to the thermal fixing portion 22, and then is discharged from the sheet outlet 24.

The thermal fixing portion 22 comprises a heat roller 31 with a heat source and a press roller 32. The heat roller 31 and the press roller 32 are arranged such that the image recording medium P on which the toner particles T adhere can pass between both rollers. The toner particles T are melted by heat from the heat roller 31, and the melted toner particles T are adhered firmly to the image recording medium P by the pressure from the heat roller 31 and the press roller 32.

The operation of the image recording apparatus 25 of this embodiment will be described with reference to FIGS. 1 and 2.

The image recording medium P, inserted through the sheet inlet 23, is supported by the guide 33 and is fed into the image recording portion 21 by a pair of the rotatable feeding rollers 34. When the image recording medium P is fed into the image recording portion 21, the supply roller 13 rotates in the direction indicated by the arrow A as shown in FIG. 1. When the supply roller 13 rotates in the direction indicated by the arrow A, the toner particles T are triboelectrically charged, for example, in a positive polarity, between the supply roller 13 and the toner particle case 14. The toner particles T charged to a positive polarity are supported on the surface of the supply roller 13 and a toner particle layer of uniform thickness is formed by a supply roller blade 15. The uniform amount of toner particles T is fed to come in contact with the brush of the brush roller 11. At this time, the toner particles T are further triboelectrically charged by contacting the brush roller 11 rotating in the direction indicated by the arrow B. Thus, the toner particles T are firmly charged with a positive polarity. The toner particles T charged with a positive polarity move from the surface of the supply roller 13 to the brush of the brush roller 11.

Below the particle control electrode the scratch member 12 scratches the brush of the brush roller 11 which supports the toner particles T. When the brush roller 11 rotates, the brush comes in contact with the scratch member 12 and bends by its own elasticity since the scratch member 12 is fixed to the position where it comes in contact with the brush of the brush roller 11. When the brush roller 11 rotates further in the direction indicated by the arrow B, the brush bends further and then clears the scratch member 12. The brush then returns to an original position by own elasticity. At this moment, the toner particles T, which are supported on the brush, are separated from the brush. As a result, the toner particles T thus separated from the brush roller 11 form a mist and are supplied below the particle control electrode 1.

The mist of the toner particles T, charged with a positive polarity, is attracted to the reference electrode 4 and is modulated by the particle control electrode 1. That is, when the image signal voltage (a negative voltage) is applied from the image signal source S to the segment control electrode 5 of the particle control electrode 1, an electric field which faces to the segment control electrode 5 from the reference electrode 4 is generated in the active aperture 2 and the toner particles T which were positively charged pass through the apertures 2.

Moreover, when the image signal voltage is not applied from the image signal source S, an electric field is not generated in the corresponding aperture 2. Therefore, the toner particles T do not pass through those apertures 2.

The toner particles T which do not pass through the apertures 2 will be attracted by the image force (the electrostatic force on a charge in the neighborhood of a conductor which may be thought of as the attraction to the charge's electric image) of the reference electrode 4. However, the piezoelectric member 9 is induced to vibrate by the vibrating voltage supplied from the variable frequency oscillator 8. The vibration is transmitted to the reference electrode 4 and generates a surface wave thereon. Therefore, the particle control electrode 1 vibrates within the range of ±100 Hz around 30 kHz. As a result, the toner particles T cannot accumulate even if they are attracted to the reference electrode 4 by electrostatic induction because the piezoelectric member 9 vibrates the reference electrode 4.

In case that the frequency of the vibration applied by the piezoelectric element 9 is invariable, the mist of the toner particles T accumulates at the position where the amplitude of the vibration of the particle control electrode is small, namely the node of the vibration, because there is not enough acceleration for shaking the toner particles T loose from the surroundings of the apertures. As a result, the weight of the particle control electrode 1 is changed by the adherence of these toner particles T and the resonance frequency is changed several tens of Hz. As a result, the amplitude of the vibration of the particle control electrode 1 is decreased a little, so that a larger amount of toner particles T is further attached to the apertures.

However, in this embodiment, vibration of the particle control electrode is changed by varying the frequency of the vibration between the range of ±100 Hz of a base resonance frequency or the reference frequency. Thus, even if the resonance frequency changes a little from 30.00 kHz, the particle control electrode 1 is resonated at least one time because it has applied a vibration which is changing between the range of ±100 Hz. Therefore, there are no constant nodes and the toner particles which do not pass through the particle control electrode 1 are not accumulated around the apertures thereof and the apertures do not become clogged. Moreover, the time for changing this frequency from 29.9 kHz to 30.1 kHz (30 kHz±100 Hz) is 1.7 milliseconds which is equal to the time for printing one dot. Therefore, because the frequency applied while one dot is formed always changes from 29.9 kHz to 30.1 kHz, the condition of the vibration becomes equal between each dot and the amount of the toner particles which pass through each aperture is not varied. Therefore, it becomes possible to obtain a uniform output print image.

During printing, the image recording medium P, inserted from the sheet inlet 23, is fed by the guide 33 and the pair of the feeding rollers 34 to the electrode roller 6 and the image recording medium P is thus transported through the image recording portion 21. The toner particles T supplied in the form of a mist are modulated with the particle control electrode 1 according to the image signal from each image signal source S connected to a corresponding segment control electrode 5. The toner particles T which pass through the particle control electrode 1 are charged with a positive polarity. As a result, the toner particles T are attracted toward the electrode roller 6 by the electric field generated between the particle control electrode 1 and the electrode roller 6 by the direct current power supply E. The toner particles T are attracted to the image recording medium P supplied on the electrode roller 6. The toner particles T that adhere to the image recording medium P after passing through each aperture 2 construct each dot of the recorded image. Therefore, the toner particles T modulated with the particle control electrode 1, according to the signal from the image signal sources S, record the image on the image recording medium P.

Afterwards, the image recording medium P on which the toner particles T adhere is fed to the thermal fixing portion 22. The recording medium P on which the toner particles T adhere is pressed by the heat roller 31 and the press roller 32 in the thermal fixing portion 22. At this time, the toner particles T on the recording medium P melt and are fixed by heat from the heat source (not shown) of the heat roller 31. A detailed explanation of the thermal fixation will be omitted because it is generally well known.

Finally, the image recording medium P on which the image is fixed is supported by a second guide 33 and is fed to the sheet outlet 24 where it is discharged from the image recording apparatus 25.

According to the image recording apparatus of the invention as described above, the particle control electrode can be vibrated constantly at a large amplitude even if it is influenced by some environmental changes, such as an adherence of the toner particles T, because the particle control electrode 1 is made to vibrate by changing the frequency around the resonance frequency of the particle control electrode 1. Therefore, the toner particles T adhered to or which would adhere to the particle control electrode 1 can obtain a large vibration acceleration to break the adherence, so that it becomes possible to prevent the apertures of the particle control electrode from being clogged by the toner particles T. Therefore, it is possible to obtain a high-quality output image using this image recording apparatus.

Moreover, it is to be understood that the invention is not limited to the above described embodiment, and various modifications and alterations can be added thereto without departing from the scope of the invention encompassed by the appended claims.

What is claimed is:

1. An image recording apparatus, comprising:

toner particle supplying means for supplying charged toner particles;

a particle control electrode having at least one row of apertures, said particle control electrode controlling passage of the charged toner particles supplied by said toner particle supplying means through the apertures;

a back electrode confronting said toner particle supplying means for attracting the toner particles passed through the apertures of said particle control electrode, said particle control electrode positioned between said toner particle supplying means and said back electrode, and said back electrode being spaced from said particle control electrode by a space enabling passage of an image recording medium;

vibration applying means for applying vibration to said particle control electrode so that the apertures of said particle control electrode are prevented from adhering the charged toner particles; and changing means for changing, in a predetermined cycle, a frequency of the vibration applied to said particle control electrode by said vibration applying means, wherein the predetermined cycle in which said changing means changes the frequency of the vibration applied by said vibration applying means is shorter than the time for recording one dot on the image recording medium.

2. The image recording apparatus according to claim 1, wherein said vibration applying means is mounted on said particle control electrode.

3. The image recording apparatus according to claim 2, wherein said vibration applying means includes a piezoelectric member.

4. The image recording apparatus according to claim 2, wherein said vibration applying means includes a plurality of vibration members mounted on said particle control electrode.

5. The image recording apparatus according to claim 1, wherein said vibration applying means vibrates while the image is recorded on the image recording medium.

6. The image recording apparatus according to claim 1, wherein a resonance frequency of said particle control electrode is greater than 20 kHz.

7. The image recording apparatus according to claim 6, wherein a resonance frequency of said particle control electrode is substantially 30 kHz.

8. The image recording apparatus according to claim 1, wherein the predetermined cycle is 1.7 milliseconds.

9. The image recording apparatus according to claim 1, wherein said changing means changes the frequency of the vibration applied by said vibration applying means in a predetermined range.

10. The image recording apparatus according to claim 9, wherein the predetermined range is ±100 Hz.

11. The image recording apparatus according to claim 3, wherein said changing means includes a variable frequency oscillator connected to said piezoelectric member for applying a voltage having a variable frequency to said piezoelectric member.

12. The image recording apparatus according to claim 11, wherein said variable frequency oscillator includes an oscillator, a voltage controlled oscillator and an amplifier.

13. The image recording apparatus according to claim 11, wherein said variable frequency oscillator applies the voltage having a variable frequency around the resonance frequency of said particle control electrode in a predetermined range.

14. An image recording apparatus for recording an image to a recording medium based on an image signal, comprising:

supplying means for supplying charged toner particles;

controlling means having a control member formed with an aperture for controlling passage of the charged toner particles through the aperture based on the image signal;

attracting means for attracting the charged toner particles which have passed through the aperture onto the recording medium;

vibrating means for vibrating the control member; and changing means for changing, in a predetermined cycle, the frequency of the vibration applied to the control member, wherein the predetermined cycle in which said changing means changes the frequency of the vibration applied by said vibrating means is shorter than the time for recording one dot on the recording medium.

15. The image recording apparatus according to claim 14, wherein said vibrating means includes a means for generating an electric signal having a predetermined frequency and a vibrating member for generating a mechanical vibration in response to the electric signal, the vibrating member being attached to the control member.

16. The image recording apparatus according to claim 15, wherein said vibrating member is a piezoelectric member.

17. The image recording apparatus according to claim 15, wherein said changing means changes the frequency in a predetermined range to generate a mechanical vibration having various frequencies.

18. An image recording apparatus, comprising:

toner particle supplying means for supplying charged toner particles;

a particle control electrode having at least one row of apertures, said particle control electrode controlling passage of the charged toner particles supplied by said toner particle supplying means through the apertures;

a back electrode confronting said toner particle supplying means for attracting the toner particles passed through the apertures of said particle control electrode;

vibration applying means for applying vibration to said particle control electrode so that the apertures of said particle control electrode are prevented from adhering to the charged toner particles; and charging means for changing, in a predetermined cycle, a frequency of the vibration applied to said particle control electrode by said vibration applying means, wherein the predetermined cycle is 1.7 milliseconds.

* * * * *